US009653237B1

(12) United States Patent
Zhou et al.

(10) Patent No.: US 9,653,237 B1
(45) Date of Patent: May 16, 2017

(54) ELECTRICAL SWITCHING APPARATUS AND SLOT MOTOR THEREFOR

(71) Applicant: EATON CORPORATION, Cleveland, OH (US)

(72) Inventors: Xin Zhou, Wexford, PA (US); Mark Alan Juds, New Berlin, WI (US); Christian Ruempler, Wexford, PA (US); Paul Jason Rollmann, Menomonee Falls, WI (US); Jason Carrodus, New Brighton, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/958,481

(22) Filed: Dec. 3, 2015

(51) Int. Cl.
*H01H 33/18* (2006.01)

(52) U.S. Cl.
CPC ..... *H01H 33/182* (2013.01)

(58) Field of Classification Search
CPC ..... H01H 9/443; H01H 9/36; H01H 33/596; H01H 9/346; H01H 71/528; H01H 9/446; H01H 33/38; H01H 50/546; H01H 1/20; H01H 33/16; H01H 33/182; H01H 33/32; H01H 33/34; H01H 51/2209; H01H 89/10
See application file for complete search history.

(56) References Cited

U.S. PATENT DOCUMENTS 4,013,984 A 3/1977 Wafer
4,077,025 A 2/1978 Slade et al.
4,743,720 A * 5/1988 Takeuchi ..... H01H 9/302 218/24
4,963,849 A * 10/1990 Kowalczyk ..... H01H 9/342 218/35
4,970,481 A * 11/1990 Arnold ..... H01H 73/18 335/16
6,052,047 A * 4/2000 Malingowski ..... H01H 71/0228 335/202
6,172,585 B1 * 1/2001 Zindler ..... H01H 71/02 200/293
6,281,459 B1 * 8/2001 Munsch ..... H01H 77/108 218/22
(Continued)

FOREIGN PATENT DOCUMENTS

EP 1 956 624 A1 8/2008

OTHER PUBLICATIONS

European Patent Office, "International Search Report and Written Opinion", PCT/US2016/062998, Jan. 31, 2017, 13 pp.

*Primary Examiner* — Truc Nguyen
(74) *Attorney, Agent, or Firm* — Eckert Seamans; John Powers; Grant Coffield

(57) ABSTRACT

A slot motor is for an electrical switching apparatus. The slot motor includes: a support apparatus including a support element having a first leg and a second leg located opposite the first leg, the first leg having a first inner surface, the second leg having a second inner surface facing the first inner surface; a plurality of permanent magnets including a first permanent magnet and a second permanent magnet, the first permanent magnet being located on the first leg, the second permanent magnet being located on the second leg; and a number of U-shaped plates coupled to the support element. The first inner surface and the second inner surface are located between the first permanent magnet and the second permanent magnet.

20 Claims, 7 Drawing Sheets

(56) References Cited

U.S. PATENT DOCUMENTS

| | | | | |
|---|---|---|---|---|
| 6,831,536 | B1 * | 12/2004 | Zindler | H01H 77/108 335/201 |
| 6,970,059 | B2 | 11/2005 | Mueller et al. | |
| 7,348,514 | B2 | 3/2008 | Puskar et al. | |
| 7,358,840 | B1 | 4/2008 | Shea | |
| 7,532,097 | B2 | 5/2009 | Malingowski et al. | |
| 8,222,983 | B2 | 7/2012 | Zhou et al. | |
| 8,368,492 | B1 | 2/2013 | Theisen et al. | |
| 9,006,601 | B2 | 4/2015 | Zhou et al. | |
| 2009/0120908 | A1 * | 5/2009 | Domejean | H01H 9/346 218/23 |
| 2013/0112656 | A1 * | 5/2013 | Schneider | H01H 9/443 218/26 |
| 2014/0061160 | A1 * | 3/2014 | Juds | H01H 9/443 218/26 |

* cited by examiner

ELECTRICAL SWITCHING APPARATUS AND SLOT MOTOR THEREFOR

BACKGROUND

Field

The disclosed concept relates to electrical switching apparatus, such as, for example, circuit breakers and, more particularly, to circuit breakers employing a slot motor. The disclosed concept further relates to slot motors.

Background Information

Electrical switching apparatus, such as circuit breakers, are employed in diverse capacities in power distribution systems. A circuit breaker may include, for example, a line conductor, a load conductor, a fixed contact and a movable contact, with the movable contact being movable into and out of electrically conductive engagement with the fixed contact. This switches the circuit breaker between an ON or closed position and an OFF or open position, or between the ON or closed position and a tripped or tripped OFF position. The fixed contact is electrically conductively engaged with one of the line and load conductors, and the movable contact is electrically conductively engaged with the other of the line and load conductors. The circuit breaker may also include an operating mechanism having a movable contact arm upon which the movable contact is disposed.

Upon initial separation of the movable contact away from the stationary contact, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Additionally, the arc, which extends between the contacts, often results in vaporization or sublimation of the contact material itself. Therefore, it is desirable to extinguish any such arcs as soon as possible upon their propagation.

To facilitate this process, circuit breakers typically include arc chutes which are structured to attract and break-up the arcs. Specifically, each arc chute includes a plurality of spaced apart arc plates. As the movable contact is moved away from the stationary contact, the movable contact moves past the ends of the arc plates, with the arc being drawn toward and between the arc plates. The arc plates are electrically insulated from one another such that the arc is broken-up and extinguished by the arc plates.

In order to successfully interrupt a DC circuit, the circuit breaker needs to generate an arc voltage higher than the system voltage to stop the current flow. A challenge with interruption is that there is often not enough current-induced magnetic force and gas dynamics to force the arc into the arc chute. One known approach to address this issue involves the placing of large permanent magnets in the arc chute to drive the arc into the arc chute. However, among other disadvantages, large permanent magnets are costly and significantly increase the size of the arc chute.

There is thus room for improvement in electrical switching apparatus and in slot motors therefor.

SUMMARY

These needs and others are met by embodiments of the disclosed concept, which are directed to an electrical switching apparatus and slot motor therefor, in which a plurality of permanent magnets are located on a support element of the slot motor.

As one aspect of the disclosed concept, a slot motor for an electrical switching apparatus is provided. The slot motor comprises: a support apparatus including a support element having a first leg and a second leg located opposite the first leg, the first leg having a first inner surface, the second leg having a second inner surface facing the first inner surface; a plurality of permanent magnets including a first permanent magnet and a second permanent magnet, the first permanent magnet being located on the first leg, the second permanent magnet being located on the second leg; and a number of U-shaped plates coupled to the support element. The first inner surface and the second inner surface are located between the first permanent magnet and the second permanent magnet.

As another aspect of the disclosed concept, an electrical switching apparatus comprises: at least one pair of separable contacts structured to move into and out of engagement with each other in order to connect and disconnect power, respectively; at least one arc chute located at or about the pair of separable contacts in order to attract and dissipate an arc and ionized gases which are generated by the pair of separable contacts moving out of engagement with each other; and at least one slot motor comprising: a support apparatus comprising a support element having a first leg and a second leg located opposite the first leg, the first leg having a first inner surface, the second leg having a second inner surface facing the first inner surface, a plurality of permanent magnets comprising a first permanent magnet and a second permanent magnet, the first permanent magnet being located on the first leg, the second permanent magnet being located on the second leg, and a number of U-shaped plates coupled to the support element. The pair of separable contacts are located between the first permanent magnet and the second permanent magnet. The first inner surface and the second inner surface are located between the first permanent magnet and the second permanent magnet.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the terms "generally U-shaped" or "generally U-shape" or "general U-shape" shall mean that the shape of a corresponding structure has the general shape of the letter "U" in which the bottom of such letter or structure is rounded, generally round, square, generally square, or partially round and partially square, or has the general shape of a base member with two leg (or arm) members extending normal or generally normal from the ends of the base member.

Figure 1:
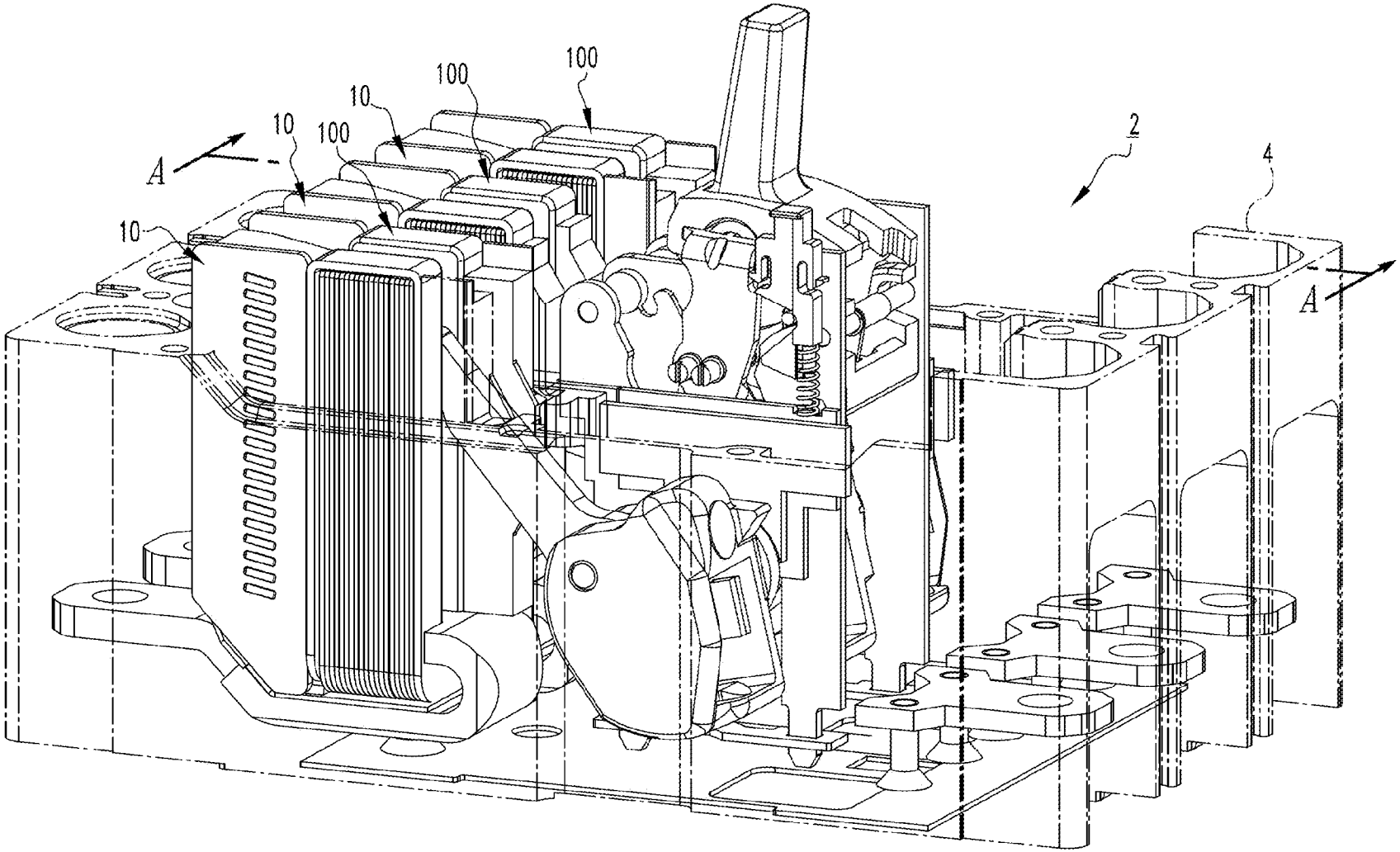
FIG. 1 is an isometric view of a portion of an electrical switching apparatus and slot motor therefor, partially shown in phantom line drawing in order to see hidden structures, in accordance with a non-limiting embodiment of the disclosed concept.
Figure 2:
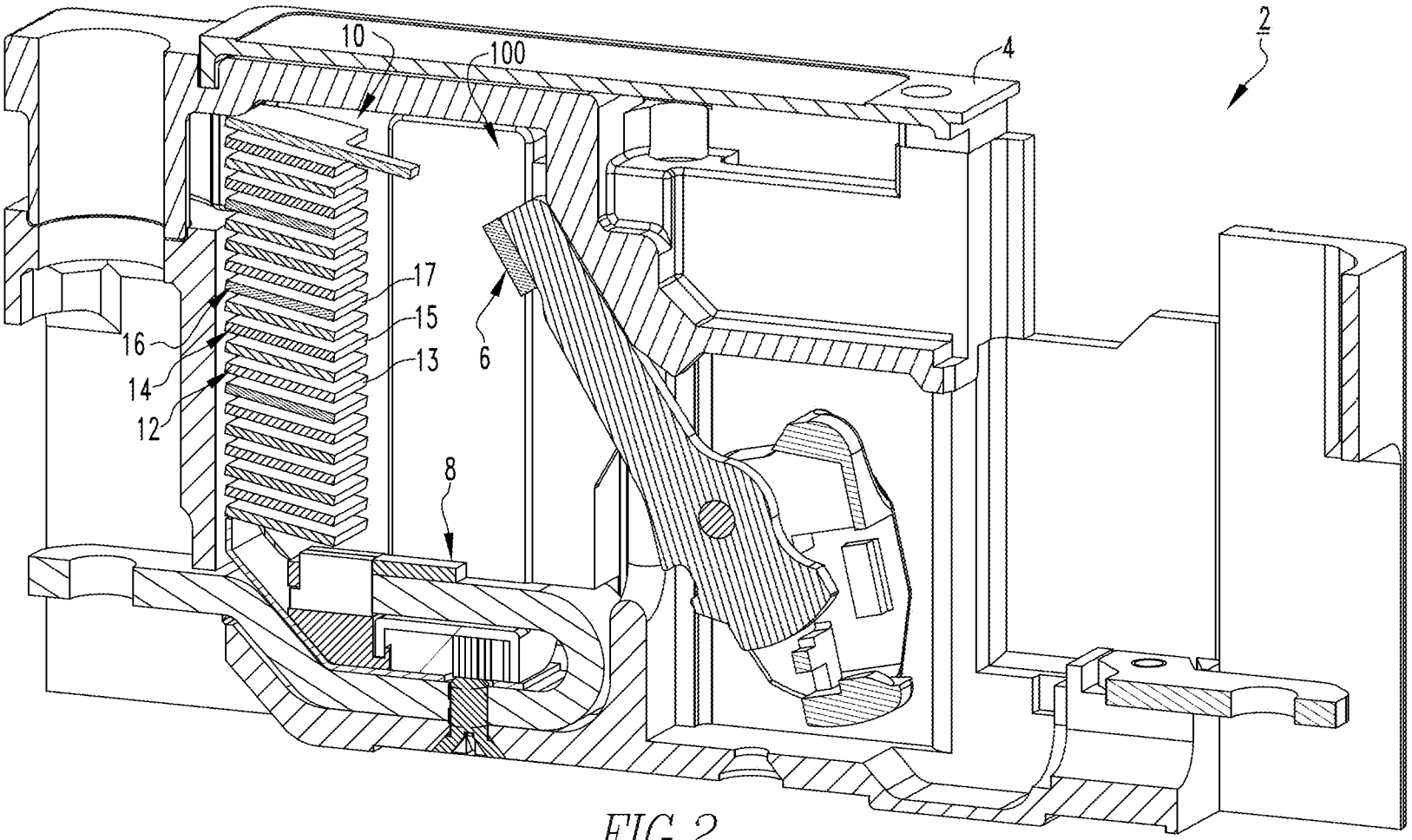
FIG. 2 is section view of the electrical switching apparatus and slot motor therefor of FIG. 1, taken along line A-A of FIG. 1.

FIG. 1 shows an electrical switching apparatus (e.g., without limitation, three-pole circuit breaker 2) in accordance with a non-limiting embodiment of the disclosed concept. FIG. 2 shows a section view of one of the poles of the example circuit breaker 2. As shown in FIG. 2, the circuit breaker 2 includes a housing 4, a pair of separable contacts (e.g., without limitation, movable contact 6 and stationary contact 8), an arc chute 10, and a slot motor 100. It will be appreciated that there are a plurality of pairs of separable contacts 6,8, a plurality of arc chutes 10, and a plurality of slot motors 100 each corresponding to one of the poles of the circuit breaker 2. The separable contacts 6,8 are structured to move into and out of engagement with each other in order to connect and disconnect power, respectively, in the circuit breaker 2. The arc chute 10 is located at or about the separable contacts 6,8 in order to attract and dissipate an arc and ionized gases which are generated by the separable contacts 6,8 moving out of engagement with each other.

Figure 3:
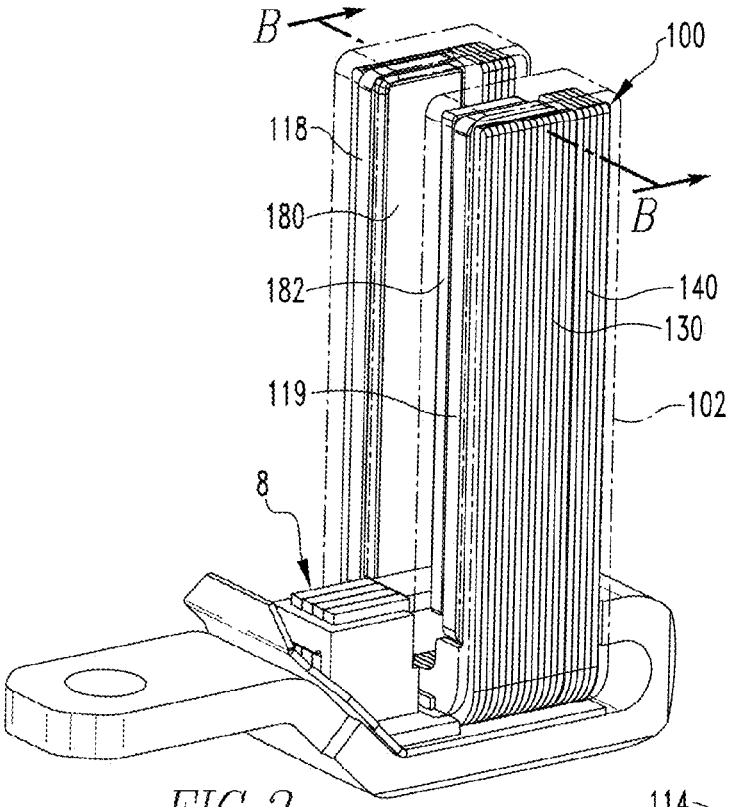
FIG. 3 is an isometric view of the slot motor of FIG. 1, partially shown in phantom line drawing in order to see hidden structures, and as employed on a line conductor.
Figure 4:
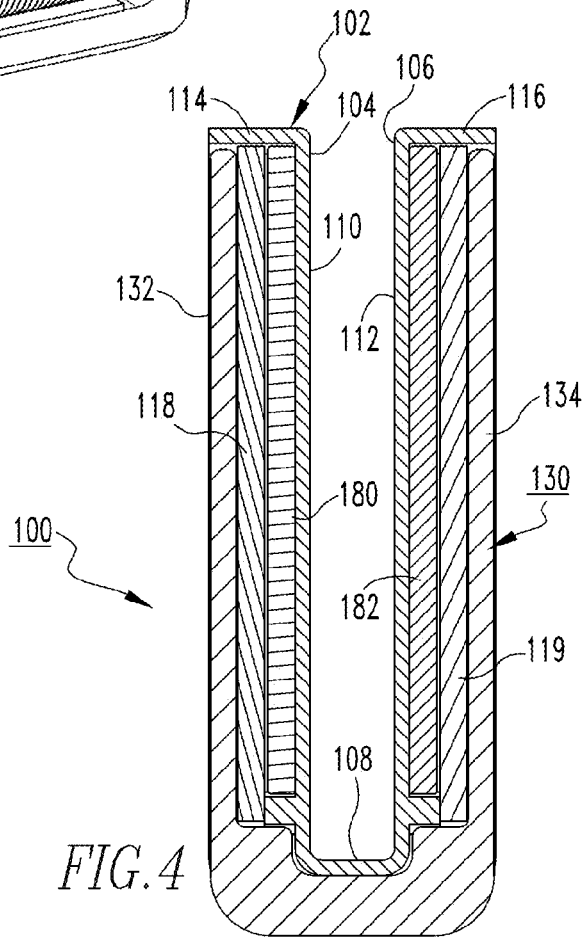
FIG. 4 is a section view of the slot motor of FIG. 3, taken along line B-B of FIG. 3, and shown without the line conductor.

Referring to FIGS. 3 and 4, the slot motor 100 includes a support apparatus in the form of a generally U-shaped support element 102, as well as a number of spacers 118,119. The slot motor 100 also includes a number of generally U-shaped plates or laminations 130,140 and a plurality of permanent magnets 180,182 each coupled to the support element 102. For ease of illustration and economy of disclosure, only the laminations 130,140 will be referenced and described, although it will be appreciated that other laminations, shown but not indicated, are shaped substantially the same as either of the laminations 130,140. As will be discussed in greater detail hereinbelow, by incorporating the permanent magnets 180,182, the slot motor 100 is advantageously able to generate relatively high arc voltage, as compared to prior art slot motors (not shown), thereby allowing the circuit breaker 2 to interrupt low-current levels as well as high-current levels.

The first and second permanent magnets 180,182 are high-energy permanent magnets (e.g., without limitation, a Samarium Cobalt (Sintered) S2869 material, or a Neodymium Iron Boron (Sintered) N2880 material). The material of the permanent magnets 180,182 advantageously generates a relatively high magnetic field, thereby allowing the permanent magnets 180,182 to be relatively small. However, it is within the scope of the disclosed concept for similar suitable alternative, yet larger, permanent magnets (not shown) to be employed, which produce a comparable magnetic field, but are made of different materials. Additionally, the material of the permanent magnets 180,182 also provides the permanent magnets 180,182 with a relatively high curie point, thereby allowing the permanent magnets 180,182 to withstand relatively high temperatures (i.e., due to heat exposure from the arc) and not lose their magnetic properties.

Non-limiting examples of the insulation material of the support element 102 are a suitable glass fiber-filled polyamide 66 and a suitable glass fiber-filled polyester. One example is Rosite® 3550D, which is marketed by Industrial Dielectrics, Inc. of Noblesville, Ind. Another example is Zytel® $PLS_{90}G_{30}DR\ BK_{099}$, which is marketed by E.I. du Pont de Nemours and Company of Wilmington, Del. This material advantageously assists in outgassing, responsive to an arcing event, as will be described below.

The support element 102 includes a first leg 104, a second leg 106, and a middle portion 108 extending between the first leg 104 and the second leg 106. The first leg 104 has a first inner surface 110, and the second leg 106 has a second inner surface 112, which faces the first inner surface 110. The first and second inner surfaces 110,112 are preferably planar and parallel to one another. As shown, the first inner surface 110 and the second inner surface 112 are located between the first permanent magnet 180 and the second permanent magnet 182, a configuration that advantageously allows the support element 102 to assist with outgassing, as will be discussed below.

Figure 5:
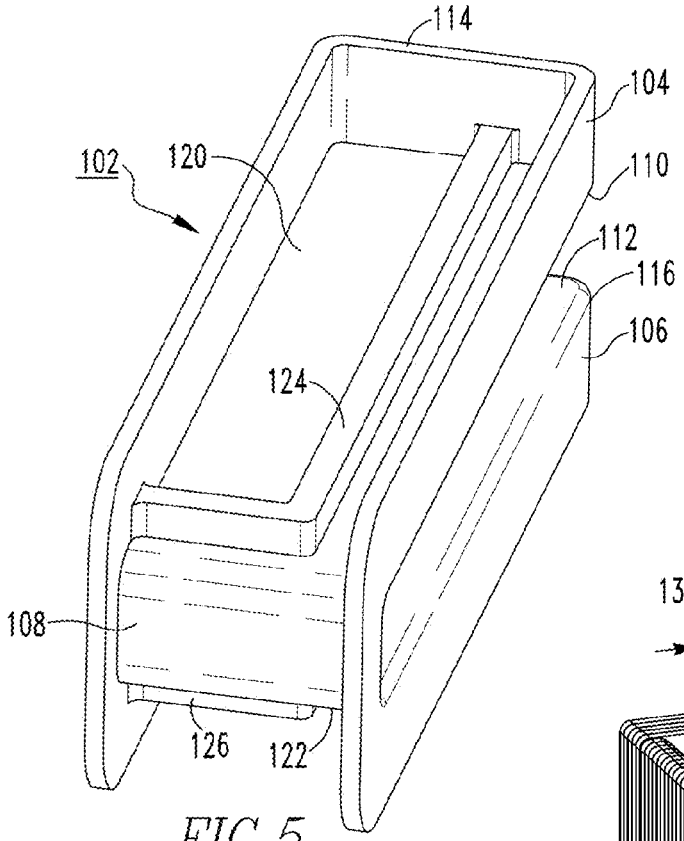
FIG. 5 is an isometric view of a support element for the slot motor of FIG. 3.

FIG. 5 shows an isometric view of the support element 102. As shown, the first leg 104 further has a first outer surface 120 and an L-shaped retaining portion 124 extending outwardly from the first outer surface 120. Similarly, although only partially shown, the second leg 106 includes a second outer surface 122 and an L-shaped retaining portion 126 extending outwardly from the second outer surface 122. The outer surfaces 120,122 are located parallel to the inner surfaces 110,112. The first permanent magnet 180 is retained on the first outer surface 120 by the retaining portion 124. The second permanent magnet 182 is retained on the second outer surface 122 by the retaining portion 126. Additionally, in one example, the first and second permanent magnets 180,182 are also adhesively bonded to the first and second outer surfaces 120,122, respectively. In this manner, the first and second permanent magnets 180,182 are advantageously able to be reliably located and retained on the respective legs 104,106. It is also within the scope of the disclosed concept to employ suitable alternative mechanisms to retain permanent magnets on a support element, such as, for example and without limitation, overmolding or a snap-fit mechanism.

Figure 6:
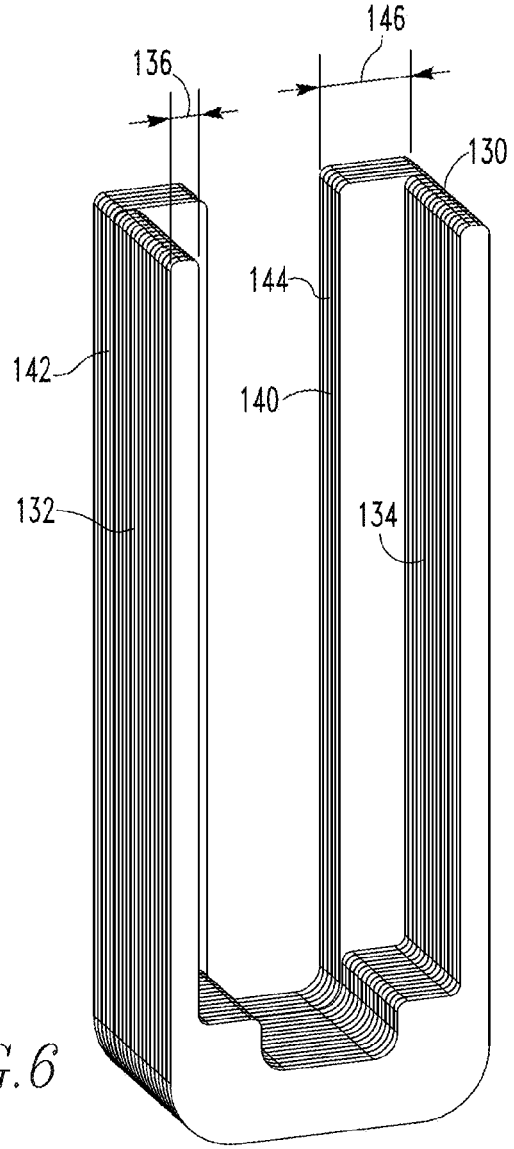
FIG. 6 is an isometric view of a plurality of plates for the slot motor of FIG. 3.

FIG. 6 shows the laminations 130,140. The laminations 130,140 each have respective first legs 132,142 and respective second legs 134,144 located opposite the first legs 132,142. Legs 132,134 each have a first width 136, and legs 142,144 each have a second width 146, which is greater than the first width 136. The first permanent magnet 180 is located between the relatively thin first leg 132 and the first inner surface 110. Similarly, the second permanent magnet 182 is located between the relatively thin second leg 134 and the second inner surface 112. The first permanent magnet 180 is not located between the first leg 142 and the first inner surface 110. Similarly, the second permanent magnet 182 is not located between the second leg 144 and the second inner surface 112. As such, the slot motor 100 accommodates the permanent magnets 180,182 with modification to some (i.e., the lamination 130), but not all (i.e., not the lamination 140) of the laminations 130,140. Accordingly, the magnetic forces generated by the laminations 130,140 are not significantly compromised by accommodating the permanent magnets 180,182.

Continuing to refer to FIGS. 5 and 6, the legs 142,144 are structured to be located on a first side of the respective retaining portions 124,126, and the permanent magnets 180,182 are structured to be located on a second, opposing side of the respective retaining portions 124,126. As shown in FIG. 4, the spacers 118,119 are located between a respective one of the legs 132,134 and a respective one of the permanent magnets 180,182. The spacers 118,119 are advantageously structured to keep the relatively thin legs 132,134 parallel with the inner surfaces 110,112 and the permanent magnets 180,182. It will be appreciated that the disclosed structure of the support element 102, the spacers 118,119, and the laminations 130,140 ergonomically allows the permanent magnets 180,182 to be included, and also allows the laminations 130,140 to generate maximum magnetic forces.

The disclosed concept will be further appreciated with reference to the following Examples. It will be appreciated that the Examples provided herein are for purposes of illustration only and are not intended to limit the scope of the disclosed concept.

EXAMPLE 1

Each of the permanent magnets 180,182 may extend from proximate the middle portion 108 to proximate a respective distal end portion 114,116 of a respective one of the legs 104,106. Additionally, the permanent magnets 180,182 may have the same magnetic orientation, for example, with a south pole located proximate the lamination 140 and a north pole located opposite the south pole (i.e., between the south pole and the arc chute 10).

Figure 7:
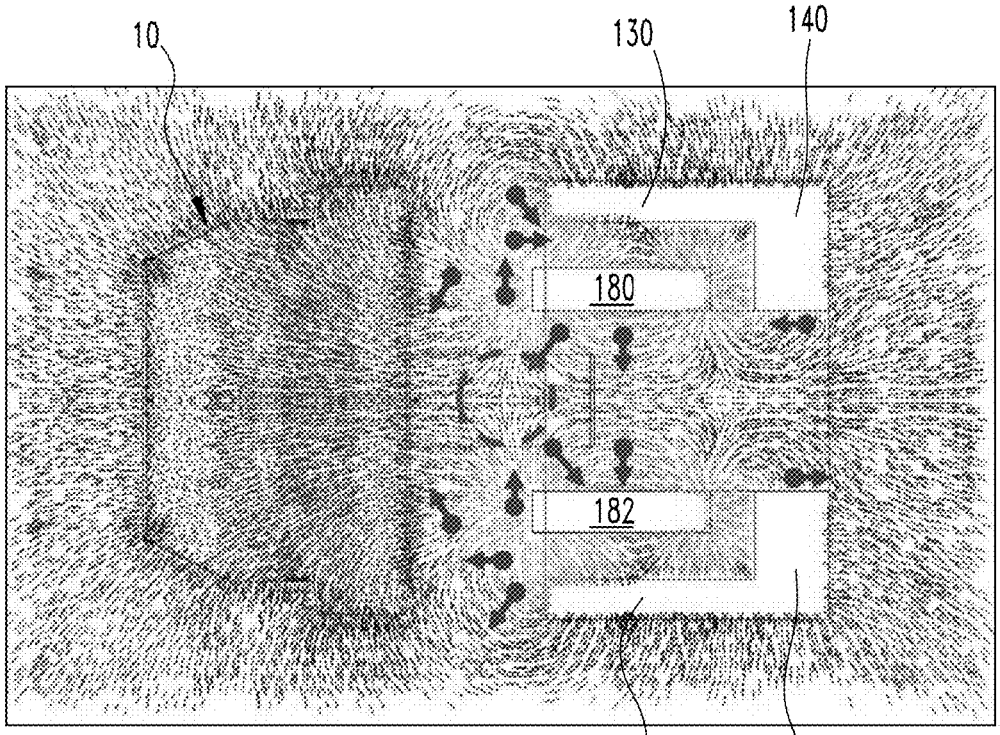
FIG. 7 is a computer generated illustration of a magnetic flux field generated by the slot motor of FIG. 3, which includes a plurality of permanent magnets, and also showing the arc chute.

A computer generated illustration of the magnetic flux field generated by the slot motor 100 for a given direction of current interruption is shown in FIG. 7. As shown, the magnetic field is operable to exert a force toward the permanent magnet 182. More specifically, the permanent magnets 180,182 are cooperatively structured to magnetically attract an arc (i.e., an arc generated by the parting of the separable contacts 6,8 (FIG. 2)) into the second inner surface 112. It will be appreciated that in an opposite direction of current interruption, the permanent magnets 180,182 cooperate to magnetically attract an arc into the first inner surface 110.

As stated above, the material of the support element 102 advantageously assists in outgassing, responsive to an arcing event. That is, when the arc is driven sideways (i.e., from the separable contacts 6,8 directly toward one of the first and second inner surfaces 110,112), the respective first or second inner surface 110,112 is partially vaporized, advantageously causing the arc to be driven into the arc chute 10. Stated differently, when the arc hits the first inner surface 110 or the second inner surface 112, the releasing of gases pushes the arc into the arc chute 10.

As a result of including the permanent magnets 180,182, the slot motor 100 is advantageously able to interrupt the circuit at relatively high current levels in addition to low current levels. More specifically, the permanent magnets 180,182 impart a novel magnetic force on the electrical arc to drive the arc sideways, and the support element 102, by way of outgassing, is advantageously able to drive the arc into the arc chute 10. This novel mechanism is superior to the mechanisms of prior art slot motors (not shown), which rely entirely on the magnetic field generated by the laminations, a mechanism that is often insufficient to drive the arc into the arc chute at low current levels. More precisely, prior art slot motors generate a magnetic field that is proportional to the current. As a result, at low current levels there is a low magnetic field which has little or no effect in moving the arc into the arc chutes. By contrast, the instant slot motor 100, by including the permanent magnets 180,182, generates a relatively high magnetic field that is independent of the current. Thus, at low current levels there is sufficient magnetic field to move the arc toward the respective permanent magnets 180,182 to generate gassing at the respective inner surfaces 110,112. Furthermore, by locating the permanent magnets in the slot motor 100 (e.g., and not the arc chute 10 as is the case with prior art circuit breakers), the permanent magnets 180,182 are able to be relatively small to drive the arc against the respective inner surfaces 110,112, in order that the arc can be driven into the arc chute 10 with a combined magnetic and fluid-dynamic force, thereby saving space in the arc chute 10 and reducing overall cost.

Additionally, referring again to FIG. 2, the arc chute 10 includes a plurality of arc plates 12,14,16 that are made of a ferromagnetic material. As a result, the arc plates 12,14,16 advantageously impart a magnetic force to pull the arc into the arc chute 10. It will also be appreciated that in an alternative example the arc plates may be made of a suitable alternative material without departing from the scope of the disclosed concept.

The arc plates 12,14,16 also each have an edge portion 13,15,17 extending from proximate the first leg 104 to proximate the second leg 106. This is distinct from prior art arc chutes (not shown) in which the arc plates extend from proximate a slot motor away from the slot motor. It will be appreciated that the disclosed novel geometry of the arc plates 12,14,16 advantageously allows for more space and volume to receive the high current arc.

EXAMPLE 2

Figure 8:
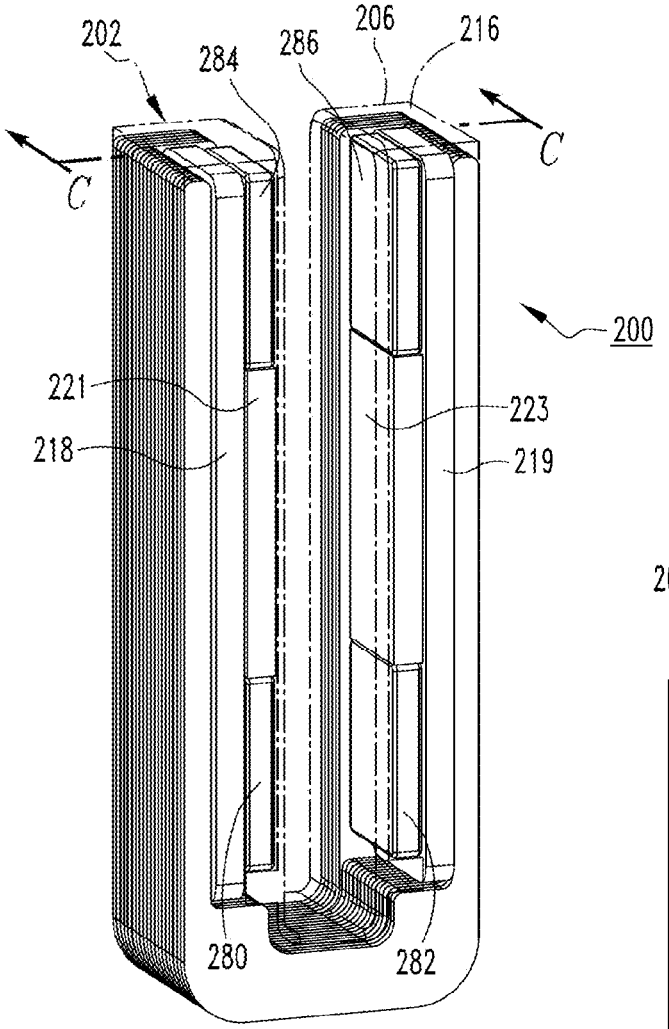
FIG. 8 is an isometric view of a slot motor, with portions shown in phantom line drawing in order to see hidden structures, in accordance with another non-limiting embodiment of the disclosed concept.
Figure 9:
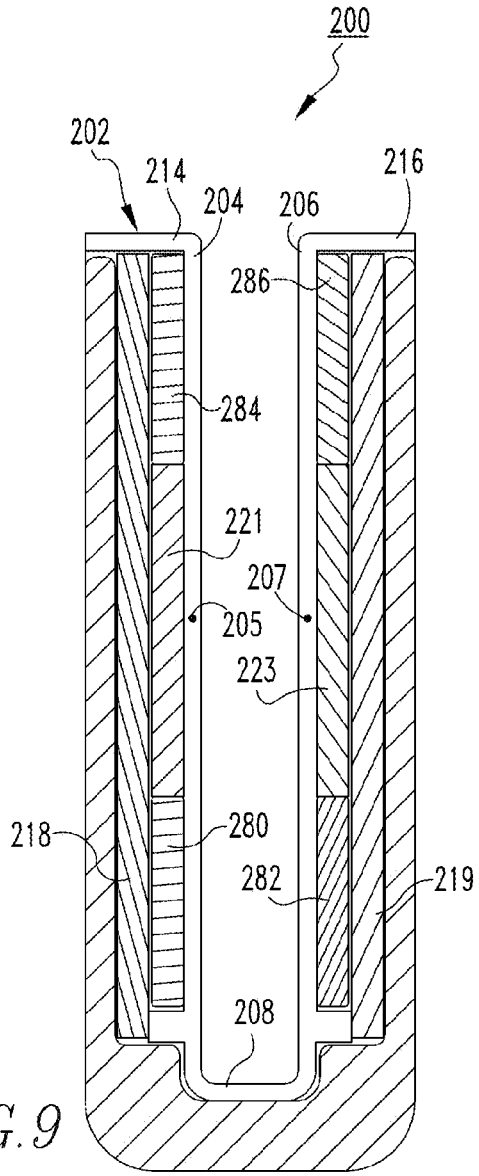
FIG. 9 is a section view of the slot motor of FIG. 8, taken along line C-C of FIG. 8.

The example of FIGS. 8 and 9 shows the alternative slot motor 200, which may be substituted into the circuit breaker 2 in place of any of the slot motors 100. As shown, the slot motor 200 includes a third permanent magnet 284 and a fourth permanent magnet 286, in addition to the first permanent magnet 280 and the second permanent magnet 282. Each respective leg 204,206 has a respective midpoint 205,207. The first permanent magnet 280 and the second permanent magnet 282 are located between the respective midpoints 205,207 and the middle portion 208. The third permanent magnet 284 and the fourth permanent magnet 286 are located between the respective midpoints 205,207 and the respective distal end portions 214,216.

Continuing to refer to FIGS. 8 and 9, the support apparatus further includes a third spacer 221 and a fourth spacer 223 in addition to the first and second spacers 218,219. As shown, the third spacer 221 is located between the first permanent magnet 280 and the third permanent magnet 284. Similarly, the fourth spacer 223 is located between the second permanent magnet 282 and the fourth permanent magnet 286. In this manner, the permanent magnets 280, 282,284,286 are advantageously able to be reliably retained on the support element 202.

By employing the relatively small permanent magnets 280,282,284,286, costs to manufacture the slot motor 200 can be reduced. It will also be appreciated that by employing the third and fourth permanent magnets 284,286, the polarity of the magnetic field can be non-uniform, as well as be uniform. More specifically, the magnetic field is uniform when the polarity of the third and fourth permanent magnets 284,286 corresponds to (i.e., is oriented the same as) the polarity of the first and second permanent magnets 280,282. However, the magnetic field is non-uniform when the polarity of the third and fourth permanent magnets 284,286 is reversed (i.e., is opposite) with respect to the polarity of the first and second permanent magnets 280,282. In a reversed configuration, the resulting magnetic field would be reversed toward a top of the slot motor 200, and thus cause the arc to bend in a serpentine path, which can improve interruption. The serpentine path stretches the arc so that the arc has more engagement with the arc plates 12,14,16, thus resulting in better cooling of the arc. As a result, a higher arc voltage is generated, which corresponds to an improved interruption for the circuit breaker 2.

EXAMPLE 3

Figure 10:
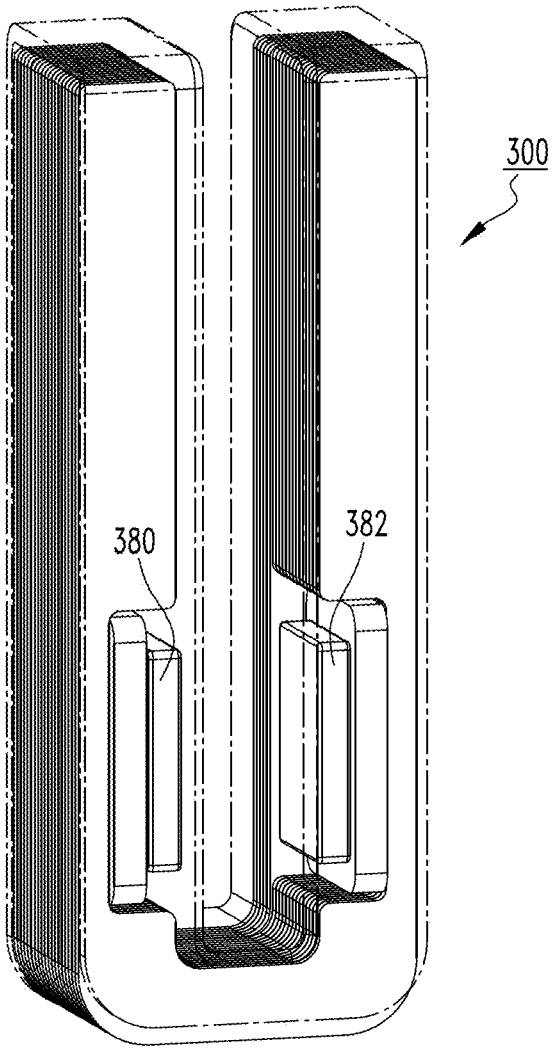
FIG. 10 is an isometric view of a slot motor, with portions shown in phantom line drawing in order to see hidden structures, in accordance with another non-limiting embodiment of the disclosed concept.

The example of FIG. 10 shows the alternative slot motor 300, which may be substituted into the circuit breaker 2 in place of any of the slot motors 100. As shown, there are only two relatively small permanent magnets 380,382 in the slot motor 300 (i.e., located between respective midpoints and the middle portion of the support element), advantageously resulting in a reduction in manufacturing costs.

It will also be appreciated that in this example there is a reversed magnetic field. More specifically, the permanent magnets 380,382 impart a magnetic force on the electrical arc toward a respective inner surface of the support element at the bottom of the support element, and the magnetic field is reversed at the top of the support element such that at the top of the support element, the electrical arc will be driven toward the opposing inner surface.

Although the examples disclosed herein have been described in association with the permanent magnets 180, 182,280,282,284,286,380,382, it will be appreciated that a suitable alternative slot motor (not shown) may have an alternative number, shape, and/or configuration of permanent magnets in order to perform the desired function of driving the electrical arc into a support element.

Accordingly, it will be appreciated that the disclosed concept provides for an improved electrical switching apparatus 2 and slot motor 100,200,300 therefor, in which a plurality of permanent magnets 180,182,280,282,284,286, 380,382 combined with outgassing allows the electrical switching apparatus 2 to not only be able to interrupt low current levels, but also be able to interrupt relatively high current levels.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A slot motor for an electrical switching apparatus, said slot motor comprising:

a support apparatus comprising a support element having a first leg and a second leg disposed opposite said first leg, said first leg having a first inner surface, said second leg having a second inner surface facing the first inner surface;

a plurality of permanent magnets comprising a first permanent magnet and a second permanent magnet, said first permanent magnet being disposed on said first leg, said second permanent magnet being disposed on said second leg; and a number of U-shaped plates coupled to said support element, wherein the first inner surface and the second inner surface are disposed between said first permanent magnet and said second permanent magnet.

2. The slot motor of claim 1 wherein said number of U-shaped plates comprises a lamination having a first leg and a second leg disposed opposite said first leg of said lamination; wherein said first permanent magnet is disposed between the first inner surface and said first leg of said lamination; and wherein said second permanent magnet is disposed between the second inner surface and said second leg of said lamination.

3. The slot motor of claim 2 wherein said support element further has a middle portion extending between said first leg of said support element and said second leg of said support element; wherein said first leg of said support element has a first midpoint; wherein said second leg of said support element has a second midpoint; wherein said first permanent magnet is disposed between the first midpoint and said middle portion; and wherein said second permanent magnet is disposed between the second midpoint and said middle portion.

4. The slot motor of claim 3 wherein said first leg of said support element further has a first distal end portion disposed opposite and distal said middle portion; wherein said second leg of said support element further has a second distal end portion disposed opposite and distal said middle portion; wherein said plurality of permanent magnets further comprises a third permanent magnet and a fourth permanent magnet; wherein said third permanent magnet is disposed between the first midpoint and said first distal end portion; and wherein said fourth permanent magnet is disposed between the second midpoint and said second distal end portion.

5. The slot motor of claim 2 wherein said support element further has a middle portion extending between said first leg of said support element and said second leg of said support element; wherein said first leg of said support element has a first distal end portion disposed opposite and distal said middle portion; wherein said second leg of said support element has a second distal end portion disposed opposite and distal said middle portion; wherein said first permanent magnet extends from proximate said middle portion to proximate said first distal end portion; and wherein said second permanent magnet extends from proximate said middle portion to proximate said second distal end portion.

6. The slot motor of claim 1 wherein said support apparatus further comprises a first spacer and a second spacer; wherein said number of U-shaped plates comprises a lamination having a first leg and a second leg; wherein said first spacer is disposed between said first permanent magnet and said first leg of said lamination; and wherein said second spacer is disposed between said second permanent magnet and said second leg of said lamination.

7. The slot motor of claim 1 wherein said number of U-shaped plates comprises a first lamination and a second lamination; wherein said first lamination has a first leg and a second leg each having a first width; and wherein said second lamination has a third leg and a fourth leg each having a second width greater than the first width.

8. The slot motor of claim 7 wherein said first permanent magnet is disposed between said first leg of said first lamination and the first inner surface; and wherein said second permanent magnet is disposed between said second leg of said first lamination and the second inner surface.

9. The slot motor of claim 8 wherein said support apparatus further comprises a first spacer and a second spacer; wherein said first spacer is disposed between said first leg of said first lamination and said first permanent magnet; wherein said second spacer is disposed between said second leg of said first lamination and said second permanent magnet; wherein said first permanent magnet is not disposed between said third leg of said second lamination and the first inner surface; and wherein said second permanent magnet is not disposed between said fourth leg of said second lamination and the second inner surface.

10. The slot motor of claim 1 wherein said first leg of said support element further has a first outer surface and a first number of retaining portions extending outwardly from the first outer surface; wherein said second leg of said support element further has a second outer surface and a second number of retaining portions extending outwardly from the second outer surface; wherein the first outer surface and the second outer surface are disposed parallel to the first inner surface and the second inner surface; wherein the first number of retaining portions retain said first permanent magnet on said first leg of said support element; and wherein the second number of retaining portions retain said second permanent magnet on said second leg of said support element.

11. The slot motor of claim 1 wherein said first permanent magnet and said second permanent magnet are cooperatively structured to magnetically attract an arc into at least one of said first inner surface and said second inner surface.

12. The slot motor of claim 1 wherein said first permanent magnet and said second permanent magnet are made of a material selected from the group consisting of Neodymium Iron Boron and a Samarium Cobalt.

13. The slot motor of claim 1 wherein said first permanent magnet is adhesively bonded to said first leg of said support element; and wherein said second permanent magnet is adhesively bonded to said second leg of said support element.

14. An electrical switching apparatus comprising:

at least one pair of separable contacts structured to move into and out of engagement with each other in order to connect and disconnect power, respectively;

at least one arc chute disposed at or about said at least one pair of separable contacts in order to attract and dissipate an arc and ionized gases which are generated by said at least one pair of separable contacts moving out of engagement with each other; and at least one slot motor comprising:

a support apparatus comprising a support element having a first leg and a second leg disposed opposite said first leg, said first leg having a first inner surface, said second leg having a second inner surface facing the first inner surface, a plurality of permanent magnets comprising a first permanent magnet and a second permanent magnet, said first permanent magnet being disposed on said first leg, said second permanent magnet being disposed on said second leg, and a number of U-shaped plates coupled to said support element, wherein said at least one pair of separable contacts are disposed between said first permanent magnet and said second permanent magnet, and wherein the first inner surface and the second inner surface are disposed between said first permanent magnet and said second permanent magnet.

15. The electrical switching apparatus of claim 14 wherein said at least one arc chute comprises a plurality of arc plates each having an edge portion extending from proximate said first leg of said support element to proximate said second leg of said support element.

16. The electrical switching apparatus of claim 14 wherein said at least one arc chute comprises a plurality of arc plates each made of a ferromagnetic material.

17. The electrical switching apparatus of claim 14 wherein said number of U-shaped plates comprises a first lamination and a second lamination; wherein said first lamination has a first leg and a second leg each having a first width; wherein said second lamination has a third leg and a fourth leg each having a second width greater than the first width; wherein said first permanent magnet is disposed between said first leg of said first lamination and the first inner surface; and wherein said second permanent magnet is disposed between said second leg of said first lamination and the second inner surface.

18. The electrical switching apparatus of claim 17 wherein said support apparatus further comprises a first spacer and a second spacer; wherein said first spacer is disposed between said first leg of said first lamination and said first permanent magnet; wherein said second spacer is disposed between said second leg of said first lamination and said second permanent magnet; wherein said first permanent magnet is not disposed between said third leg of said second lamination and the first inner surface; and wherein said second permanent magnet is not disposed between said fourth leg of said second lamination and the second inner surface.

19. The electrical switching apparatus of claim 14 wherein said first permanent magnet and said second permanent magnet are cooperatively structured to magnetically attract the arc into at least one of said first inner surface and said second inner surface.

20. The electrical switching apparatus of claim 14 wherein said at least one pair of separable contacts is a plurality of pairs of separable contacts; wherein said at least one arc chute is a plurality of arc chutes; wherein said at least one slot motor is a plurality of slot motors; and wherein said electrical switching apparatus is a circuit breaker.

* * * * *